US005501707A

United States Patent [19]

Schieferstein et al.

[11] Patent Number: 5,501,707

[45] Date of Patent: Mar. 26, 1996

[54] AQUEOUS DISPERSIONS OF NEW AMPHIPHILIC CO-OLIGOMERS FOR THE WASHING- AND CLEANING-RESISTANT OILING OF LEATHER AND SKINS AND THEIR USE

[75] Inventors: Ludwig Schieferstein, Ratingen; Rudolf Zauns-Huber; Joachim Conradi, both of Duesseldorf; Emil Ruscheinsky, Leverkusen, all of Germany

[73] Assignee: Henkel Kommanditgesellschaft auf Aktien, Duesseldorf, Germany

[21] Appl. No.: 204,168

[22] PCT Filed: Aug. 24, 1992

[86] PCT No.: PCT/EP92/01938

§ 371 Date: May 3, 1994

§ 102(e) Date: Mar. 3, 1994

[87] PCT Pub. No.: WO93/05188

PCT Pub. Date: Mar. 18, 1993

[30] Foreign Application Priority Data

Sep. 3, 1991 [DE] Germany ..... 41 29 244.8

[51] Int. Cl.[6] ..... C14C 9/00

[52] U.S. Cl. ..... 8/94.23; 8/94.21; 8/94.22; 8/94.18; 8/94.33; 252/8.57

[58] Field of Search ..... 8/94.18, 94.21, 8/94.22, 94.23, 94.33, 94.26; 252/8.57; 524/317; 526/318

[56] References Cited

U.S. PATENT DOCUMENTS

| | | | |
|---|---|---|---|
| 4,605,721 | 8/1986 | Jenkins et al. | 527/312 |
| 4,755,187 | 7/1988 | Friese et al. | 8/94.23 |

FOREIGN PATENT DOCUMENTS

| | | |
|---|---|---|
| 0193832 | 9/1986 | European Pat. Off. . |
| 0216089 | 4/1987 | European Pat. Off. . |
| 0372746 | 6/1990 | European Pat. Off. . |
| 0412389 | 7/1990 | European Pat. Off. . |
| 0418661 | 3/1991 | European Pat. Off. . |
| 1669347 | 5/1971 | Germany . |
| 61-171775 | 8/1986 | Japan . |

*Primary Examiner*—Prince Willis, Jr.
*Assistant Examiner*—Alan D. Diamond
*Attorney, Agent, or Firm*—Ernest G. Szoke; Wayne C. Jaeschke; Daniel S. Ortiz

[57] ABSTRACT

The invention is a process for oiling of leather and skins which imparts washing and dry-cleaning resistance to the treated leather and skins and a composition useful in the process. The washing and dry-cleaning resistance of leather is improved by impregnating the leather with an aqueous dispersion of a co-oligomer containing residues of a partial ester of maleic acid and acrylic acid and/or methacrylic acid and optionally up to 45% by weight of residues of ether hydmphilic and oleophilic monomers. The composition can contain semiesters of sulfosuccinic acid as additional oiling agents.

20 Claims, No Drawings

AQUEOUS DISPERSIONS OF NEW AMPHIPHILIC CO-OLIGOMERS FOR THE WASHING- AND CLEANING-RESISTANT OILING OF LEATHER AND SKINS AND THEIR USE

This application is a 371 of PCT/EP92/01938 filed Aug. 8, 1992.

FIELD OF THE INVENTION

The oiling of vegetable- and/or mineral-tanned leathers and skins is an essential process step in the treatment cycle leading to the ready-to-use leather- or skin-based useful material. The manner in which the oil is distributed in the skin and the extent to which the oil components are bound into the skin critically determine the properties and usefulness of the end products. Extensive specialist knowledge exists on possible interactions between the oil components on the one hand and the tanned skin containing residual tanning agents on the other hand. The particular composition of the oiling preparations, for example the number of lipophilic groups and any reactive groups present for reaction with suitable reactive constituents in the tanned leather, determines inter alia the durability and effectiveness of the oiling treatment in the practical use of the leather and hide goods.

One aspect which is still important in practice is the provision of oiling preparations which can be bound in the tanned skin so reliably that the leather and hide goods are sufficiently resistant to washing and cleaning for practical requirements. High-quality leather goods, for example in the clothing industry, are supposed to lend themselves both to washing with detergents and even to dry cleaning without any significant loss of quality. The further requirement of adequate water tightness of the oiled leather is required in special cases.

BACKGROUND OF THE INVENTION

Basically, there are three known processes for the waterproofing of leather and skins, namely:

1. impregnation by incorporation of water-insoluble substances, for example solid fats, waxes or special polymers,
2. impregnation by incorporation of water-swelling substances which form high-viscosity emulsions on taking up water and which block the interstices between the leather fibers, for example special emulsifiers of the w/o type,
3. treatment with hydrophobicizing substances, for example aluminium, chromium and/or zirconium complexes, silicones or organic fluorine compounds.

RELATED ART

DE 1 669 347 describes the use of water-emulsifiable sulfosuccinic acid semiesters for oiling leather, although no waterproofing effects are obtained. EP 193 832 describes a process for the production of waterproof leathers and skins using sulfosuccinic acid monoesters in combination with impregnating and/or hydrophobicizing oiling preparations which is characterized in that, after retanning, the leathers or skins are treated in aqueous solution with impregnating and/or hydrophobicizing oiling preparations containing sulfosuccinic acid monoester salts with $C_{12-24}$ fatty residues and, after acidification, are fixed by addition of a chromium, zirconium and/or aluminium salt. The sulfosuccinic acid monoester salts are preferably used with impregnating oiling preparations from the group consisting of oxidized or oxidized and partly sulfonated $C_{18-26}$ hydrocarbons or $C_{32-40}$ waxes, phosphoric acid mono-$C_{12-24}$-alkyl esters, citric acid mono-$C_{16-24}$ -alkyl esters, sorbitan, glycerol and/or pentaerythritol-$C_{16-24}$-fatty acid esters.

Amphiphilic preparations in the form of selected co-oligomers of, on the one hand, hydrophilic or oleophilic monomers and, on the other hand, hydrophilic monomer constituents have recently been described and recommended for the wet end treatment of, in particular, mineral-tanned leathers and skins. Amphiphilic preparations of this type may be incorporated, for example by milling, in the leathers or skins to be treated in the form of aqueous dispersions, emulsions and/or solutions on completion of the primary tanning stage. In the particular case of mineral-tanned leathers or skins, these amphiphilic preparations may also perform the retanning function. Finally, the amphiphilic preparations may be fixed in a final step, more particularly with mineral tanning agents. The more recent patent literature describes auxiliaries of the type in question. For example, EP 372 746 describes corresponding preparations and their use, the amphiphilic copolymers consisting predominantly of at least one hydrophobic monomer and, to a minor extent, of at least one copolymerizable hydrophilic monomer. The hydrophobic monomers mentioned include long-chain alkyl (meth)acrylates, long-chain alkoxy or alkylphenoxy(polyethyleneoxide) (meth)acrylates, primary alkenes, vinyl esters of long-chain alkyl carboxylic acids and mixtures thereof. The hydrophilic comonomers present to a minor extent are ethylenically unsaturated water-soluble acids or hydrophilic basic comonomers. The molecular weight (weight average) of the copolymers is in the range from 2,000 to 100,000.

EP 412 389 describes the use of copolymers which have been prepared by radical copolymerization of (a) $C_{8-40}$ monoolefins with (b) ethylenically unsaturated $C_{4-8}$ dicarboxylic anhydrides along the lines of bulk polymerization at temperatures of 80°to 300° C. to form copolymers having molecular weights of 500 to 20,000 g/mole, subsequent solvolysis of the anhydride groups of the copolymers and at least partial neutralization of the carboxyl groups formed during the solvolysis step in aqueous medium with bases and which are present in the form of aqueous dispersions or solutions as preparations for hydrophobicizing leathers and skins. Finally, EP 418 661 describes the use for the same purpose of copolymers which contain (a) 50 to 90% by weight of $C_{8-40}$ alkyl (meth)acrylates, vinyl esters of $C_{8-40}$ carboxylic acids or mixtures thereof and (b) 10 to 50% by weight of monoethylenically unsaturated $C_{3-12}$ carboxylic acids, monoethylenically unsaturated dicarboxylic anhydrides, semiesters or semiamides of monoethylenically unsaturated $C_{4-12}$ dicarboxylic acids, amides of $C_{3-12}$ monocarboxylic acids or mixtures thereof in copolymerized form and which have molecular weights of 500 to 30,000 g/mole. The copolymers are used for the stated purpose in at least partly neutralized form either in aqueous solution or in aqueous dispersion.

Extensive work carried out by applicants has shown that the wide variety of materials used in practice in the wet end treatment of leather and skins on the one hand and the highly individual and variously pronounced form of the intermediate stages in the production of leather and skins make it desirable to broaden the possibilities available for the oiling and, optionally, retanning treatment of wet end leathers. Accordingly, the problem addressed by the present invention was to provide a new class of amphiphilic co-oligomers which could be used in an improved manner in the above-described treatment of pretanned leathers and skins and which, in particular, would be capable of thoroughly impregnating the skin and, on the one hand, of achieving the required oiling and, optionally, even certain hydrophobicizing effects while, on the other hand, replacing the otherwise standard retanning treatment. More particularly, the invention set out to enable an at least substantially cleaning-resistant oiling effect to be obtained so leathers and skins treated in this way would lend themselves to washing with detergents and/or to dry cleaning without suffering significant losses of value.

To solve the problem stated above, the invention uses the class of co-oligomers described hereinafter, if desired even in the form of a mixture with other oiling and/or hydrophobicizing, more particularly known mixture components. In one embodiment, both the class of amphiphilic co-oligomers selected in accordance with the invention and the above-described auxiliaries optionally used can be fixed in the skin by an aftertreatment, more particularly with mineral tanning agents.

BRIEF SUMMARY OF THE INVENTION

In a first embodiment, therefore, the present invention relates to the use of aqueous dispersions of co-oligomers from the radical-initiated aqueous emulsion copolymerization at a pH in the mildly acidic to neutral range of (a) semiesters of maleic acid with oleophilic alcohols and/or lower alkylene oxide adducts thereof and (b) acrylic acid and/or methacrylic acid as principal components which may additionally contain (c) small quantities of other hydrophilic and/or oleophilic comonomers in the oligomer molecule, as an amphiphilic preparation for the oiling, washing-resistant and dry-cleaning-resistant treatment of leather and skins.

In this embodiment, the invention relates to the use of the aqueous dispersions of these amphiphilic preparations above all for the treatment of mineral-tanned leather and/or skins. In this treatment, the above-described amphiphilic preparations according to the invention may also assume or perform a retanning function.

In a first embodiment, the present invention relates to aqueous dispersions of the amphiphilic co-oligomers of the above-defined components (a) and (b) and optionally (c), the molar ratios of (a) to (b) in these co-oligomers being in the range from about 1:1 to 2:1. The optional component(s) (c) are present in smaller quantities by weight, based on the sum total of (a)+(b). The aqueous dispersions are adjusted to pH values in the neutral to mildly basic range and are present in particular as a water-dilutable water-containing paste with useful-material contents of the co-oligomer of the order of 30 to 50% by weight.

DETAILED DESCRIPTION OF THE INVENTION

The key element of the invention is the use of the co-oligomers of semiesters of maleic acid with selected oleophilic alcohols—component (a)—and acrylic acid and/or methacrylic acid—component (b), hereinafter also referred to in the interests of simplicity as (meth)acrylic acid—as principal components. These co-oligomers may additionally contain small quantities of either hydrophilic comonomers and/or oleophilic comonomers. These optionally additional components of the co-oligomer molecule are collectively referred to as components of type (c).

It is crucial to the function of the co-oligomers in accordance with the invention that a lipophilic part of the co-oligomer molecule—the semiester function of maleic acid with oleophilic alcohols—should be attached to the carboxyl groups both from the monomer constituents of (a) and from those of (b).

In preferred embodiments of co-oligomers corresponding to the definition according to the invention, at least substantially equal quantities of (a) to (b) are used in the synthesis of the co-oligomer molecule, although component (a) is preferably used in a molar excess over component (b). This ensures that a large percentage of oiling and/or hydrophobicizing lipophilic molecular constituents is introduced into the wet end leather to be treated, although on the other hand the co-oligomer molecule contains a sufficiently large number of free carboxyl groups emanating both from constituents (a) and from constituents (b). According to the invention, therefore, oiling effects can be selectively obtained in the fiber structure of the leather or skin, although at the same time a large number of free reactive carboxyl groups is available for interaction with the skin and/or auxiliaries already present or subsequently introduced, more particularly mineral tanning agents. The desired combination of the plurality of treatment effects is thus selectively obtainable in a controllable manner. More particularly, the auxiliary can be fixed in the skin structure in such a way that cleaning by washing and/or dry cleaning is possible without any effect on the soft, oiled leather structure.

It has been found that preferred molar ratios of (a) to (b) are in the range from about 1:1 to about 2:1.

The following observations apply to the comonomer component (a):

This component is formed by semiesters of maleic acid with lipophilic or oleophilic alcohols. Instead of or in addition to the alcohols, alkylene oxide adducts thereof with a limited number of alkylene oxide groups adapted in known manner to the chain length of the alcohols may also be used. Relevant particulars can be found, for example, in EP 193 832 cited at the beginning. Accordingly, in the case of the semiesters of maleic acid with lower alkylene oxide adducts of oleophilic alcohols which are optionally used in component (a), it is preferred to derivatize the last-mentioned components with at most 6 alkylene oxide groups and preferably with up to 4 alkylene oxide groups. Relatively low degrees of alkoxylation are preferably assigned to relatively short chain lengths while relatively high degrees of alkoxylation within the relatively low range mentioned may be assigned to relatively long chain lengths. Particularly suitable alkylene oxide groups are corresponding EO groups.

However, one important embodiment of the invention uses oleophilic maleic acid semiesters with no such alkylene oxide derivatization as component (a). In this case, semiesters of maleic acid with linear and/or branched oleophilic alcohols containing at least predominantly 8 to 10 or more carbon atoms in the molecule are particularly suitable. The use of corresponding maleic acid semiesters of which the alcohol radicals contain 12 to 24 carbon atoms and are generally saturated or, if desired, may even be at least partly monoolefinically and/or polyolefinically unsaturated can be preferred. Particularly important ester-forming fatty alcohols are corresponding components of natural origin which are obtained in known manner, for example by reduction, from fatty acids of natural origin. Saturated $C_{12-18}$ fatty alcohols can be particularly important for the formation of the monomeric components (a). Optimized oiling and, at the same time, water-repellent effects are obtained using these components on their own or in combination with other components.

However, it has been found that other important properties for the use of the co-oligomers in accordance with the invention can be controlled by slight variations even in the alcohol radicals of the monomer component (a). The use of branched alcohols to a limited extent is particularly mentioned in this regard. The use of limited quantities of branched alcohols clearly promotes the ability of the co-oligomer to penetrate into the fiber structure of the skin to be treated, small quantities of branched alcohols being sufficient to initiate the desired effects. Branched alcohols may even contain less than 12 carbon atoms in the molecule, corresponding components containing at least 6 carbon atoms and preferably at least 8 carbon atoms being suitable. One important branched alcohol which may be used in the preparation of the maleic acid semiesters (a) is 2-ethylhexanol. However, the quantity in which the branched and, in particular, relatively short-chain alcohols are used will always be comparatively limited. Thus, generally no more than 20% by weight and preferably no more than 15% by weight or even 10% by weight of the alcohol components present in (a) are formed by lower branched-chain alcohols. Quantities of the order of 95% by weight of strongly oleophilic long-chain fatty alcohols, more particularly in the $C_{12-18}$ range, with around 5% by weight of a branched-chain alcohol of the 2-ethylhexanol type have proved to be adequate for practical purposes.

The components (a) are obtained in known manner from maleic anhydride by alcoholysis with the particular hydrophobic fatty alcohol or alcohol mixture selected.

The preferred monomer component (b) is acrylic acid, although mixtures of acrylic acid and methacrylic acid with, in particular, predominant quantities of acrylic acid may also be used.

The co-oligomerization, which will be described in more detail hereinafter, is best carried out in such a way that the co-oligomers formed have average molecular weights (weight averages) of around 500 to 20,000. Particularly suitable co-oligomers of the type mentioned have corresponding average molecular weights in the range from about 1,000 to 10,000.

If desired, additional oleophilicizing monomer components (c) and/or additional hydrophilicizing monomer components (c) may be used in the synthesis of the co-oligomer molecule. If, for example, the water-repellent effect is to be intensified, copolymerizable oleophilic monomer compounds, for example the (meth)acrylates of long-chain alcohols known from the prior art, may be additionally used. On the other hand, the character of fixability or retannability can be strengthened by the incorporation of further acid groups, for example vinylsulfonic acid and the like. In the preferred embodiment, however, the amphiphilic preparations according to the invention contain the optional component(s) (c) in comparatively small quantities by weight, based on the sum of (a)+(b). This applies in particular to co-oligomers of the described type which additionally contain oleophilic components (c). In important embodiments, their content amounts to no more than 45% by weight and, more particularly, to less than 30% by weight of the co-oligomer. One particularly important embodiment is characterized by the use of co-oligomers which have been prepared without the addition of oleophilic components (c). According to the invention, additional oiling and/or hydrophobicizing effects can be obtained by using other mixture components which will be separately discussed hereinafter.

The Production Of The Co-Oligomers To Be Used In Accordance With The Invention According to the invention, the co-oligomers of (a), (b) and optionally (c) are produced by aqueous emulsion copolymerization. To this end, the following procedure may usefully be adopted:

The separately prepared maleic acid semiester is very finely emulsified in lightly preheated water, if necessary after melting. A preferably mildly acidic to neutral pH value is established by alkalization, more particularly with NaOH. Preferred pH values are in the range from about 4.5 to 7 and, more particularly, in the range from 6 to 7. At temperatures near the boiling point of water, typically above 90° C., an aqueous solution of component(s) (b), more particularly acrylic acid, is added and the preferably mildly acidic pH value established in advance is maintained by simultaneous pH regulation. At the same time, an initiator for the radical reaction, more particularly hydrogen peroxide, is added. On completion of the reaction, which normally lasts several hours, including an after-reaction phase, a neutral to mildly alkaline pH value is adjusted in the aqueous reaction medium. It is possible in this way to prepare pastes of which the co-oligomer useful-material content is in the range from about 30 to 45% by weight, for example, and which contain unreacted constituents only in quantities of well below 1% by weight and preferably below 0.5% by weight. Preferred pH values for the storable product are in the range from pH 7 to 8. The pastes may be mixed at any time with water and/or aqueous active-substance mixtures of the type described in the following and used in the form of the resulting mixtures.

Another important embodiment is characterized by the use of amphiphilic preparations of the described type which have been produced, particularly at the aqueous co-oligomerization stage, using emulsifiers which, on introduction into leathers and/or skins, particularly mineral-tanned leathers and/or skins, develop an additional oiling or hydrophobicizing effect and which, preferably at the same time, can be fixed in the tanned leather or skin via acidic groups. One important example of compounds this type are the water-emulsifiable sulfosuccinic acid semiesters mentioned at the beginning which emanate from long-chain fatty alcohols and/or alkylene oxide adducts thereof. The foregoing observations on the semiesters of the maleic acid component (a) apply equally to the particular character of the alcohols. One important example of emulsifiers of this class are $C_{18}$ sulfosuccinate semiesters which may be used, for example, in quantities of 5 to 10% by weight (water-free basis) in the co-oligomerization reaction. It has been found that advantageous effects can be obtained by using such emulsifier-like auxiliary components (which basically are already known as finishing agents for the oiling of leather) in the co-oligomerization reaction carried out in accordance with the invention. For example, particularly fine-particle, water-containing paste-like reaction products with high useful-material contents of co-oligomers are formed.

However, auxiliaries of this type need not necessarily have been used as mixture components in the course of the co-oligomerization reaction, instead they may also be subsequently added as mixture components to the aqueous useful-material mixture used in accordance with the invention. The following are mentioned as examples of compounds of this type: sulfosuccinic acid semiesters of long-chain fatty alcohols containing in particular 12 to 24 carbon atoms and/or alkylene oxide adducts thereof, preferably containing up to 6 alkylene oxide groups, corresponding sulfosuccinic acid semiesters of fatty acid mono- and/or diglycerides and alkylene oxide adducts thereof preferably containing up to 6 alkylene oxide groups, the fatty acid(s) again preferably containing 12 to 24 carbon atoms, long-chain sulfofatty acids, more particularly corresponding α-sulfofatty acids preferably containing 12 to 24 carbon atoms and, more preferably, 16 to 18 carbon atoms; in the case of these α-substituted sulfofatty acids, the hydrocarbon radicals are typically saturated, and internal sulfofatty acids of monoolefinically and/or polyolefinically unsaturated carboxylic acids, such as oleic acid, linoleic acid, linolenic acid and the like.

However, oiling or hydrophobicizing agents in the form of the useful-material mixtures known from EP 193 832 cited at the beginning may also be used together with the co-oligomers in the composition according to the invention. In this embodiment of the process according to the invention, therefore, the co-oligomers of (a), (b) and optionally (c) defined in accordance with the invention are combined with impregnating and/or hydrophobicizing oiling agents containing sulfosuccinic acid monoester salts with $C_{12-24}$ fatty residues in combination with other impregnating oiling agents selected in particular from the group of oxidized or oxidized and partly sulfonated $C_{18-26}$ hydrocarbons or $C_{32-40}$ waxes. Other examples of these additional impregnating oiling agents are phosphoric acid mono-$C_{12-24}$-alkyl esters, partial esters of polycarboxylic acids, such as citric acid mono-$C_{16-24}$-alkyl esters, partial esters of polyalcohols, such as sorbitan, glycerol or pentaerythritol $C_{16-24}$ fatty acid esters.

Where useful-material mixtures such as these are used, the quantity of co-oligomers of (a), (b) and optionally (c) defined in accordance with the invention is preferably at least about 35% by weight, based on the useful-material mixture and, more particularly, at least about 50% by weight. It may be advisable to use at least about 70 to 80% by weight of the total useful-material mixture based on the co-oligomers according to the invention to be introduced into the wet end leather to be oiled.

The introduction of the co-oligomers in the form of an aqueous dispersion or in the form of mixtures with the other components mentioned is carried out by methods known per se, cf. in particular the observations on comparable products in the documents cited at the beginning. Accordingly, only a brief summary need be given at this juncture:

The co-oligomer dispersions according to the invention are suitable for the treatment of typical tanned skins, more particularly corresponding material which has been tanned with mineral tanning agents. The tanned skins are normally deacidified before the treatment. They may already have been dyed before the treatment. However, dyeing may also be carried out after the treatment according to the invention.

The leather to be impregnated is wet-treated with the dispersions in an aqueous liquor over a period of up to a few hours, optionally in several stages, at temperatures in the range from about 20°to 60° C. and preferably at temperatures in the range from 30°to 50° C., best at pH values in the range from about 4 to 10 and preferably at pH values of 5 to 8. The treatment is carried out, for example, by milling in a drum. The quantity of co-oligomer dispersion required is normally from 0.1 to 30% by weight and more particularly from 1 to 20% by weight, based on the pared weight of the leather or the wet weight of the skins. The liquor length is normally from 10 to 1,000% and preferably from 30 to 150%; in the case of skins, it is from 50 to 500%.

On completion of the treatment with the aqueous liquor, the pH value of the treatment liquor is displaced into the mildly acidic range by addition of acids. The addition of organic acids, preferably formic acid, is particularly suitable. Preferred pH values are in the range from 3 to 5 and preferably in the range from about 3.5 to 4. If desired, fixing may subsequently be carried out with, in particular, mineral tanning agents, the use of aluminium salts being particularly preferred.

The following Examples describe first the production of co-oligomers suitable in accordance with the invention and then their use for the treatment of wet end leather in accordance with the invention.

EXAMPLES

A general procedure for the production of the oligomers according to Examples 1 to 6 based on acrylic acid and maleic acid/fatty alcohol semiester and optionally maleic acid is first described in the following. The molar ratio of acrylic acid to maleic acid derivative is 1:1.44.

A mixture of maleic acid semiester and optionally maleic anhydride and water in a quantity sufficient to give an approximately 44% by weight reaction mixture is introduced into a reaction vessel equipped with a stirrer, heating system, cooling system, reflux condenser, temperature gauge and three feed vessels. To this end, the following procedure is adopted:

The water is introduced first into the thoroughly stirred reaction vessel and heated to around 35° C. Where maleic anhydride is used (Examples 1 and 2), this component is first added in portions at such a rate that the internal temperature of the reaction mixture remains below about 55° C. (time required around 20 minutes, possibly with gentle external cooling). After the maleic anhydride has completely dissolved, the maleic acid semiester, if necessary melted, is added. The solution is then neutralized to a pH value of approximately 7.0 by the addition in portions of NaOH pellets. The internal temperature rises to at most 80° C.

The contents of the reactor are then heated to 90° C.

Three feed solutions are prepared in advance of and separately from the mixture described above, namely: feed solution 1—acrylic acid/water (demineralized); feed solution 2—ammonium peroxydisulfate/water (demineraiized); feed solution 3—35% by weight hydrogen peroxide.

After the temperature in the reactor has reached 90° C., addition of the feed solutions and the initiator is commenced. The following starting formulation is used:

Initial mixture: 1.44 moles (maleic acid semiester and optionally maleic anhydride) + water in a quantity sufficient to form a 44% by weight mixture 2 moles of sodium hydroxide pellets Feed solution 1: 72 parts by weight of acrylic acid (AA), approximately 1 mole, 32 parts by weight of water (demineralized)

Feed solution 2: 8 parts by weight of ammonium peroxydisulfate dissolved in 32 parts by weight of water (demineralized)

Feed solution 3: 28 parts by weight of 35% hydrogen peroxide

Feed solution 1 is uniformly added over a period of 5 hours. At the same time, feed solutions 2 and 3 are uniformly introduced over a period of 6 hours at an internal temperature of 100° C. (a gentle reflux may occur).

The reaction mixture is then heated for 1 hour at 100° C.

After cooling to around 80° C., a pH value of approximately 7 is adjusted by careful addition of an aqueous 20% sodium hydroxide solution.

The end products obtained in the form of beige-colored pastes of which the dry residue (IR drying balance, 150° C.) is determined.

Example 5

The semiester with $C_{12}$ fatty alcohol—no addition of MA—is used as the reaction component based on maleic acid.

Example 6

The reaction component based on MA semiester is the mixture identified in the following Table of the semiesters based on $C_{16/18}$ fatty alcohols and 2-ethyl-hexanol (2-EHOH). In contrast to Example 3, however, twice the quantity of water is used in the initial mixture from the outset. The reaction product obtained separates into two phases after 24 hours at room temperature.

TABLE 1

| | Quantities in moles | | | | | | |
|---|---|---|---|---|---|---|---|
| Example | MA | semi-ester | Acrylic acid (AS) | NaOH (g) 33% solution | % Dry residue | Appearance End product | pH Value |
| 1 | 0.72 | 0.72 $C_{12}$ | 1.0 | 128 | 43.2 | Beige, pasty | 7.0 |
| 2 | 0.72 | 0.72 $C_{16}$ | 1.0 | 128 | 38.4 | Light yellow, pasty | 7.5 |
| 3 | | 1.20 $C_{16/18}$ 0.06 2-EHOH | 0.875 | 110.3 | 25.4 | Beige, creamy | 7.5 |
| 4 | | 1.20 $C_{16/18}$ 0.06 2-EHOH | 0.875 | 110.3 | 36.4 | Beige, pasty | 2.4 |
| 5 | | 3.78 $C_{12}$ | 2.625 | 330.9 | 38.8 | Beige, pasty | 7.3 |
| 6 | | 1.83 $C_{16/18}$ | 1.34 | 196 | 25.0 | after 24 h/RT = 2 phases | |

The following special observations apply where necessary Examples 1 to 6 summarized hereinafter in tabular form.

Example 1

A mixture based on maleic anhydride (MA) and maleic anhydride semiester (MA semiester) is used as the reaction component based on maleic acid. The semiester is prepared by reaction of the corresponding quantity of MA with $C_{12}$ fatty alcohol.

Example 2

A mixture of MA/MA semiester is used in this case, too. The semiester is the reaction product of MA with $C_{16}$ fatty alcohol. The oligomer formed is initially lumpy, a homogeneous reaction mixture only being obtained after standing overnight and heating.

Example 3

The MA semiester is a mixed product based on the alcohol components $C_{16/18}$ fatty alcohol mixture and 2-ethyl hexanol (2-EHOH); for the quantity ratio, see the following Table. The reaction mixture is extremely lumpy during the reaction and is subsequently diluted with water on account of its high viscosity.

Example 4

The aqueous maleic acid semiester mixture corresponds to the mixture of Example 3, except that $C_{18}$ sulfosuccinate semiester is additionally added as an emulsifier. A highly viscous but homogeneous reaction mixture is formed.

Using oligomer compounds corresponding to the definition according to the invention, chrome leather samples are treated with the oligomers according to the invention under the working conditions of Examples 7 to 11 below.

Example 7

Type of leather: upper leather (with fixing)

Starting material: wet blue

Percentages based on pared weight

Initial pH value: 4.0

| Step | % by wt. | Product/remarks | °C. | Running time (mins) | pH |
|---|---|---|---|---|---|
| Washing | 200 | Water<br>Drain off liquor | 40 | 15 | 4.1 |
| Neutralization | 100<br>0.5 | Water<br>Na formate<br>Drain off liquor | 40 | | 4.3 |
| Treatment (hydrophobicizing + retanning) | 100<br>5.4<br>+ 0.7 | Water<br>Oligomer of invention<br>Formic acid<br>Drain off liquor | 40 | 90<br>30 | 4.2 |
| Fixing | 100<br>0.5<br>+ 4 | Water<br>Formic acid<br>33% basic chrome tanning agent<br>Drain off liquor | 40 | 10<br>90 | 3.8<br>3.5 |
| Washing | 300 | Water<br>Drain off liquor | 40 | 15 | |
| Washing | 300 | Water | 25 | 15 | 4.2 |

Hoard up leather overnight, stretch, vacuum dry for 1.5 mins/70° C.

Example 8

Type of leather: upper leather (without fixing)
Starting material: wet blue
Percentages based on pared weight
Initial pH value: 4.0

| Step | % by wt. | Product/remarks | °C. | Running time (mins) | pH |
|---|---|---|---|---|---|
| Washing | 200 | Water | 40 | 15 | 4.1 |
| | | Drain off liquor | | | |
| Neutralization | 100 | Water | 40 | | |
| | 0.5 | Na formate | | | 4.3 |
| | | Drain off liquor | | | |
| Treatment | 100 | Water | 40 | | |
| | 5.4 | Oligomer of invention | | 90 | |
| | + 0.7 | Formic acid | | 30 | 4.2 |
| | + 0.5 | Formic acid | | 60 | 3.8 |
| | | Drain off liquor | | | |
| Washing | 300 | Water | 40 | 15 | |
| | | Drain off liquor | | | |
| Washing | 300 | Water | 25 | 15 | 4.2 |

Hoard up leather overnight, stretch, vacuum dry for 1.5 mins/70° C.

Example 9

Type of leather: upper leather
Starting material: wet blue
Percentages based on pared weight
Initial pH value: 4.0

| Step | % by wt. | Product/remarks | °C. | Running time (mins) | pH |
|---|---|---|---|---|---|
| Washing | 200 | Water | 40 | 15 | |
| | | Drain off liquor | | | |
| Neutralization | 100 | Water | 40 | | |
| | 1 | Complex-active neutralizing agent (Coratyl MK) | | 30 | 4.3 |
| Treatment | + 5 | Oligomer of invention | | 90 | 5.3 |
| + oiling | + 0.7 | Formic acid | | 30 | 4.2 |
| | | Drain off liquor | | | |
| Fixing | 100 | Water | 40 | | |
| | 1 | Complexing dicarboxylic acid | | | |
| | 6 | Basic aluminium tanning agent (Pellutax ALP) | | 60 | 3.1 |
| | + 0.5 | NaAl silicate (Coratyl G) | | 30 | 3.6 |
| | | Drain off liquor | | | |
| Washing | 300 | Water | 25 | 15 | |
| | | Drain off liquor | | | |
| Washing | 300 | Water | 25 | 15 | |

Hoard up leather overnight, vacuum dry at 70° C.

Example 10

Type of leather: clothing leather
Starting material: wet blue
Percentages based on pared weight
Initial pH value: 3.9

| Step | % by wt. | Product/remarks | °C. | Running time (mins) | pH |
|---|---|---|---|---|---|
| Washing | 200 | Water | 30 | | |
| | 0.3 | Formic acid | | 10 | |
| | | Drain off liquor | | | |
| Neutralization | 150 | Water | 40 | | |
| | 1.5 | Na acetate | | 15 | 4.8 |
| | + 2.5 | Na bicarbonate | | 60 | 6.7 |
| | | Drain off liquor | | | |
| Dyeing | 200 | Water | 50 | | |
| | 3 | Ammonia | | 5 | |
| | + 4 | Dye | | 60 | |
| Treatment | + 6 | Oligomer of invention | | 60 | |
| | + 2 | Formic acid | | 15 | |
| | + 2 | Formic acid | | 30 | 4.0 |
| | | Drain off liquor | | | |
| Fixing | 100 | Water | 50 | | |
| | 1 | Formic acid | | | 5 |
| | + 4 | 33% basic chrome tanning agent | | 90 | 3.6 |
| | | Drain off liquor | | | |
| Washing | 300 | Water | 25 | 15 | |
| | | Drain off liquor | | | |
| Washing | 300 | Water | 25 | 15 | 3.9 |

Hoard up leather overnight, wet-tenter, dry-mill, tenter.

Example 11

Type of leather: furniture leather
Starting material: wet blue
Percentages based on pared weight
Initial pH value: 4.0

| Step | % by wt. | Product/remarks | °C. | Running time (mins) | pH |
|---|---|---|---|---|---|
| Washing | 200 | Water | 35 | 10 | |
| | | Drain off liquor | | | |
| Neutralization | 100 | Water | 35 | | |
| | 2 | Na acetate | | 30 | 4.8 |
| | + 1.5 | Na bicarbonate | | 60 | 6.0 |
| | | Drain off liquor | | | |
| | 300 | Water | 55 | 10 | |
| | | Drain off liquor | | | |
| Dyeing | 100 | Water | 55 | | |
| | 1 | Ammonia | | 10 | 8.5 |
| | + 3 | Dye | | 45 | |
| Treatment | + 6 | Oligomer of invention | | 90 | |
| + retanning | + 6 | Vegetable-synth. tanning agent | | 30 | 5.9 |
| | + 1.5 | Formic acid | | 15 | |
| | + 1.5 | Formic acid | | 30 | 3.8 |
| | | Drain off liquor | | | |
| Fixing | 200 | Water | 40 | | |
| | 0.5 | Formic acid | | 10 | |
| | + 4 | 33% basic chrome tanning agent | | 90 | 3.6 |
| | | Drain off liquor | | | |
| Washing | 300 | Water | 30 | 15 | |
| | | Drain off liquor | | | |
| Washing | 300 | Water | 25 | 15 | |

Hoard up leather overnight, wet-staple, dry, moisten, mill, tenter.

The products of Examples 1, 4 and 5 corresponding to the definition according to the invention are used as oligomers according to the invention in tabulated Examples 7 to 11. Soft, supple and very full leathers are obtained in every case, being distinguished by a pleasant feel and by high grain stability.

The samples can be washed in aqueous detergent solutions (30° C.) and dry-cleaned without permanent damage to the product properties. Even after repeated cleaning steps of the described type, there is no indication of permanent stiffening of the leather.

We claim:

1. A process for the washing and dry-cleaning resistant oiling of mineral tanned leather and skins which comprises: introducing co-oligomers into the leather by contacting the leather with an aqueous dispersion of the co-oligomers formed by the radical-initiated aqueous emulsion copolymerization at a mildly acidic to neutral pH of a composition comprising:

(a) semiesters of maleic acid with at least one alcohol selected from the group consisting of oleophilic alcohols and alkylene oxide adducts of oleophilic alcohols;

(b) at least one of acrylic acid and methacrylic acid; and (c) from 0 to 45% by weight of the co-oligomer of at least one monomer selected from the group consisting of hydrophilic and oleophilic monomers which are not (a) or (b).

2. The process of claim 1 wherein the co-oligomers comprise a molar ratio of (a) to (b) of from 1:1 to 2:1.

3. The process of claim 1 wherein the aqueous dispersion is formed from co-oligomers comprising as component (a) semiesters of maleic acid with oleophilic alcohols selected from the group consisting of alcohols containing 8 to 24 carbon atoms and alcohols containing 8 to 24 carbon atoms and from 1 to 6 alkylene oxide groups.

4. The process of claim 1 wherein the co-oligomers are formed from component(s) (a) comprising maleic acid semiesters formed from the reaction of maleic anhydride with a mixture of linear fatty alcohols containing from 8 to 24 carbon atoms and tip to 20% by weight of the alcohol moieties in (a) of branched alcohols containing less than 12 carbon atoms.

5. The process of claim 1 wherein component (a) comprises a mixture of semiesters of maleic acid with fatty alcohols of natural origin containing at least 12 carbon atoms and branched alcohols containing at least 6 carbon atoms, the branched alcohol comprising not more than 15% by weight of the alcohol residues present in total in (a).

6. The process of claim 1 wherein (c) consists essentially of oleophilic components and comprises less than 30% by weight of the co-oligomers.

7. The process of claim 1 wherein the co-oligomer have a weight average molecular weight of 500 to 20,000.

8. The process of claim 1 wherein the aqueous dispersion of the co-oligomers is prepared by forming an aqueous, emulsion of the maleic acid semiesters at a pH of 4.5 to 7, initiating the radical reaction with slow addition of at least one of acrylic acid and methacrylic acid and, optionally, component(s) (c), the pH being adjusted continuously or at intervals to a value within the range of from 4.5 to 7 and final adjustment of the pH value in the end product of from 4.5 to 7.

9. The process of claim 1 wherein the co-oligomers are formed by the aqueous co-oligomerization of (a), (b) and optionally (c) in the presence of emulsifiers which comprise leather oiling agents.

10. The process of claim 1 wherein after the co-oligomers are introduced into the mineral tunnel leather and skins, the co-oligomers are fixed therein by an after treatment with mineral tanning agents.

11. The process of claim 1 wherein the co-oligomers are introduced into the leather as a retanning agent.

12. The process of claim 3 wherein the oleophilic alcohols comprise alcohols containing from 12 to 24 carbon atoms.

13. The process of claim 3 wherein the alkylene oxide groups comprise ethylene oxide groups.

14. The process of claim 4 wherein (b) comprises acrylic acid.

15. The process of claim 4 wherein the branched alcohol comprises alcohol containing at least 6 carbon atoms.

16. The process of claim 7 wherein the co-oligomers have a weight average molecular weight of from 1,000 to 10,000.

17. The process of claim 9 wherein the emulsifiers contain acid groups and are introduced into the leather with the co-oligomers and are fixed to the leather or skin by the acidic groups.

18. An aqueous dispersion comprising co-oligomers of:

(a) semiesters of maleic acid with at least one alcohol selected from the group consisting of oleophilic alcohols and alkylene oxide adducts of oleophilic alcohols;

(b) at least one of acrylic acid and methacrylic acid; and (c) from 0 to 45% by weight of the co-oligomers of at least one co-monomer selected from the group consisting of hydrophilic and oleophilic comonomers, which are not (a) or (b) and wherein the molar ratio of (a) to (b) from 1:1 to 2:1; and wherein said dispersion further contains at least one leather oiling agent selected from the group consisting of sulfosuccinic acid semiesters of long-chain fatty alcohols with 12 to 24 carbon atoms, sulfosuccin acid semiesters of alkylene oxide adducts of long-chain fatty alcohols with 12 to 24 carbon atoms, sulfosuccinic acid semiesters of fatty acid monoglyceride, sulfosuccinic acid semiesters of alkylene oxide adducts of fatty acid monoglyceride, sulfosuccinic acid semiesters of fatty acid diglycerides, sulfosuccinic acid semesters of alkylene oxide adducts of fatty acid diglycerides, $C_{12}$–$C_{24}$ α-sulfofatty acids, and internal sulfonates of $C_{12-24}$ olefinically unsaturated fatty acids.

19. The aqueous dispersion as claimed in claim 18 wherein said oiling agent is sulfosuccinic acid semiesters with $C_{12-24}$ fatty alcohols and said dispersion additionally contains at least one material selected from the group consisting of oxidized $C_{18}$–$C_{26}$ hydrocarbons, oxidized $C_{32-40}$ waxes, oxidized and partly sulfonated $C_{18-26}$ hydrocarbons, oxidized and partly sulfonated $C_{32-40}$ waxes, phosphoric acid mono-$C_{12-24}$-alkyl esters, partial alkyl esters of polycarboxylic acids, partial esters of polyalcohols, with $C_{18-24}$ fatty acids.

20. The aqueous dispersion of claim 18 containing from 30% to 50% by weight solids.

* * * * *